US005311256A

United States Patent [19]

Hamamichi et al.

[11] Patent Number: 5,311,256

[45] Date of Patent: May 10, 1994

[54] IMAGE FORMING APPARATUS MAINTAINING IMAGE DENSITY STABILITY AGAINST HUMIDITY

[75] Inventors: Suguru Hamamichi; Yoshihiro Hattori; Yoshinobu Hada, all of Toyokawa, Japan

[73] Assignee: Minolta Camera Kabushiki Kaisha, Osaka, Japan

[21] Appl. No.: 708,737

[22] Filed: May 31, 1991

[30] Foreign Application Priority Data

Jun. 4, 1990 [JP] Japan ..... 2-146456

[51] Int. Cl.[5] ..... G03G 21/00

[52] U.S. Cl. ..... 355/208; 355/246

[58] Field of Search ..... 355/246, 215, 208, 245, 355/214

[56] References Cited

U.S. PATENT DOCUMENTS

| | | | |
|---|---|---|---|
| 4,314,755 | 2/1982 | Kinashi | 355/208 X |
| 4,521,103 | 6/1985 | Ohtsuka et al. | 355/208 X |
| 4,888,618 | 12/1989 | Ishikawa | 355/208 |
| 5,034,772 | 7/1991 | Suzuki | 355/208 |
| 5,148,218 | 9/1992 | Nakane et al. | 355/208 |

FOREIGN PATENT DOCUMENTS

| | | | |
|---|---|---|---|
| 53-115233 | 10/1978 | Japan | 355/208 |
| 57-116370 | 7/1982 | Japan | 355/208 |
| 58-33271 | 2/1983 | Japan . | |
| 58-214174 | 12/1983 | Japan | 355/208 |
| 59-124359 | 7/1984 | Japan | 355/246 |
| 59-174873 | 10/1984 | Japan | 355/208 |
| 61-98370 | 5/1986 | Japan | 355/246 |
| 62-154199 | 4/1988 | Japan | 355/246 |
| 2-054264 | 2/1990 | Japan . | |
| 3-261980 | 11/1991 | Japan . | |

*Primary Examiner*—A. T. Grimley
*Assistant Examiner*—Shuk Y. Lee
*Attorney, Agent, or Firm*—Price, Gess & Ubell

[57] ABSTRACT

An image forming apparatus having a toner density detecting sensor, a humidity sensor and a memory for storing past record of detected humidity. The toner density is compensated by referring to the detected toner density, currently detected humidity and past record of humidity to maintain image density stability.

23 Claims, 4 Drawing Sheets

START
S1
MAIN SW ON ?
YES
NO
S2
TIMER ← 60min
S3
TIME UP ?
NO
YES
S4
Hn ← Hn-1
S5
Ho ← SENSOR 31
H1 ← Ho
S6
INTIALIZE
TIMER ← 10min
S7
Σ Hn / n
S8
READ SENSOR 32
Ho ← SENSOR 31
S9
CORRECTION
S10
S11
GREATER ?
NO
YES
S12
SUPPLY TONER
S13
LESSER ?
NO
S14
RECOVER
S15
COPY OPERATION
S16
MAIN SW ON ?
NO
YES
S17
TIME UP ?
NO
YES
S18
Hn ← Hn-1
S19
Ho ← SENSOR 31
H1 ← Ho

IMAGE FORMING APPARATUS MAINTAINING IMAGE DENSITY STABILITY AGAINST HUMIDITY

BACKGROUND OF THE INVENTION

1. Field of the Invention

The present invention relates to an image forming apparatus such as copying machines, laser printers and the like, and more specifically relates to an image forming apparatus capable of maintaining image density stability against varying humidity conditions.

2. Description of the Related Arts

In the aforesaid type of copying machine and the like, image density will vary depending upon the external environment. More specifically, when the developing material is allowed to sit undisturbed over a long period of time under high moisture conditions (for example, at night), a large quantity of toner will adhere to the surface of the photosensitive drum upon the initial developing due to a reduction in the amount of charge maintained by the toner as a result of the gradual loss of said charge during storage. As a result, the print density becomes too dense, thereby causing the so-called fog phenomenon.

Japanese Unexamined Patent Application No 58-33271 proposes a method for correcting a standard T/C (ratio of toner content to carrier content) based in the output of a humidity sensor that detects the humidity during machine operation.

The amount of electrical charge on the toner is changed in conjunction with variations in humidity. When the humidity changes in the increasing direction, the toner charge is reduced in proportion to the increase in humidity, but the toner charge is not likewise increased proportionately when the humidity changes in the decreasing direction. More specifically, the toner charge is gradually increased after a certain time period has elapsed.

Thus, when the standard T/C is corrected based on the humidity during the copying operation by the aforesaid conventional method, problems seldom arise when the humidity changes in the increasing direction, although when the humidity changes in the decreasing direction, the standard T/C ratio becomes larger before the toner charge increases. The aforesaid situation results in excessively dense print density and like disadvantages.

SUMMARY OF THE INVENTION

A main object of the present invention is to provide an image forming apparatus capable of stable image density against changes in humidity.

A further object of the present invention is to provide an image forming apparatus capable of suitable image density control against changes in humidity over time.

These and other objects of the invention are accomplished by storing in memory the changes in humidity over time so as to control the image density in accordance with the current humidity and the aforesaid degrees of variation stored in memory.

BRIEF DESCRIPTION OF THE DRAWINGS

These and other objects or features of the present invention will become apparent from the following description of the preferred embodiments thereof taken in conjunction with the accompanying drawings, in which.

DETAILED DESCRIPTION OF THE PREFERRED EMBODIMENT

Figure 1:
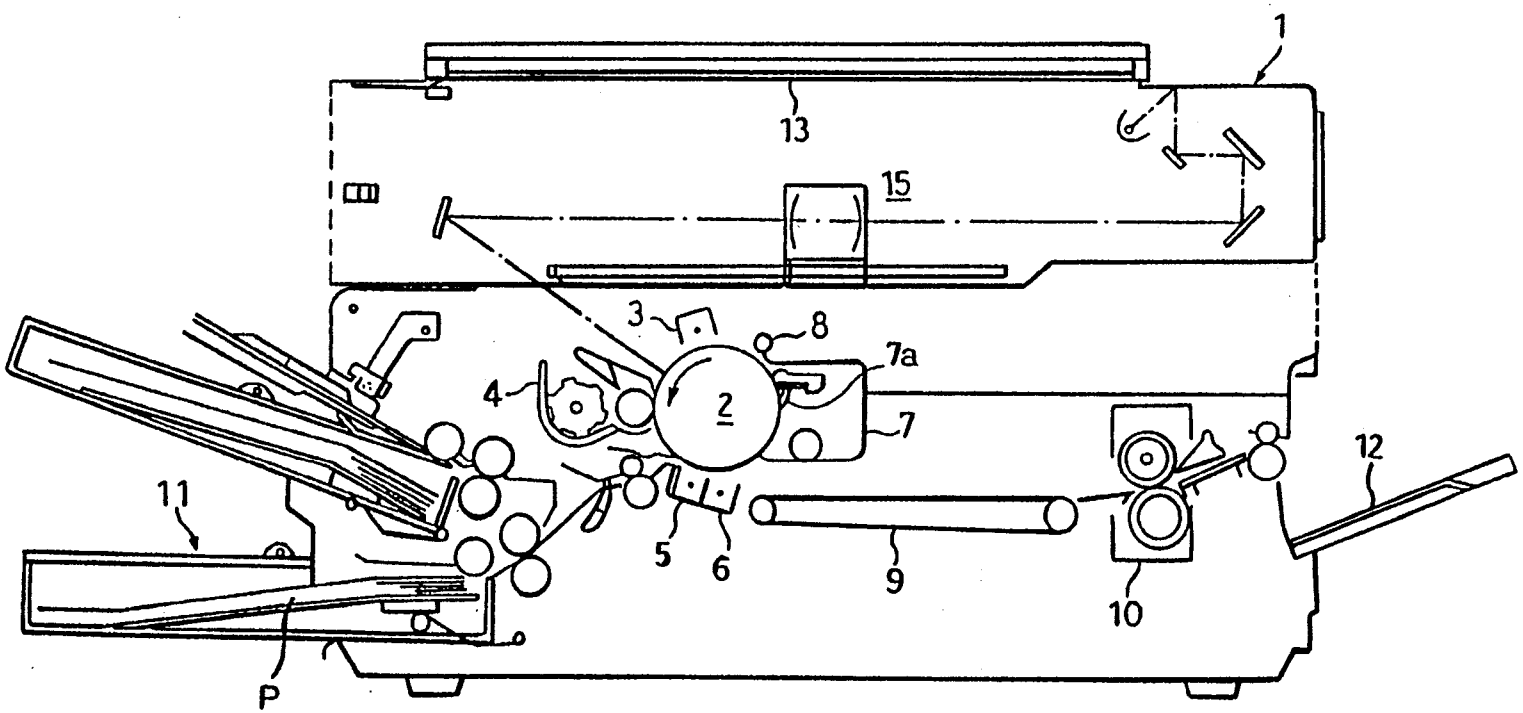
FIG. 1 is a section view showing an electrophotographic copying machine incorporating an embodiment of the present invention.

When the print switch, not shown in the drawing, is switched ON in the electrophotographic copying machine shown in FIG. 1, the photosensitive drum 2 centrally disposed in the copying machine main unit 1 is rotated in the counterclockwise direction, and the surface of the photosensitive drum 2 is charged by a charger 3 during the rotation of said drum 2. The image on an original document (not shown in the drawing) disposed on the document platen 13 provided at the top portion of the main unit 1 is projected onto the surface of the photosensitive drum 2 by means of the mirrors and lenses of the optical unit 15, so as to form an electrostatic latent image on the surface of the photosensitive drum 2 corresponding to the document image.

The aforesaid electrostatic latent image is developed so as to form a toner image on the surface of the photosensitive drum 2. Then, the toner image is transferred by means of the transfer charger 5 to the copy sheet P which is transported from the paper supply unit 11.

Thereafter, the copy sheet P is separated from the drum 2 by the separation charger 6, and passes the transport belt 9 and the fixing unit 10. The copy sheet P is then discharged to the discharge tray 12.

On the other hand, the residual toner remaining on the surface of the photosensitive drum 2 is removed therefrom by the blade *7a* of the cleaning device 7. Then, after the surface is cleaned, the residual charge remaining on the surface of the photosensitive drum 2 is eliminated by the eraser lamp 8.

Figure 2:
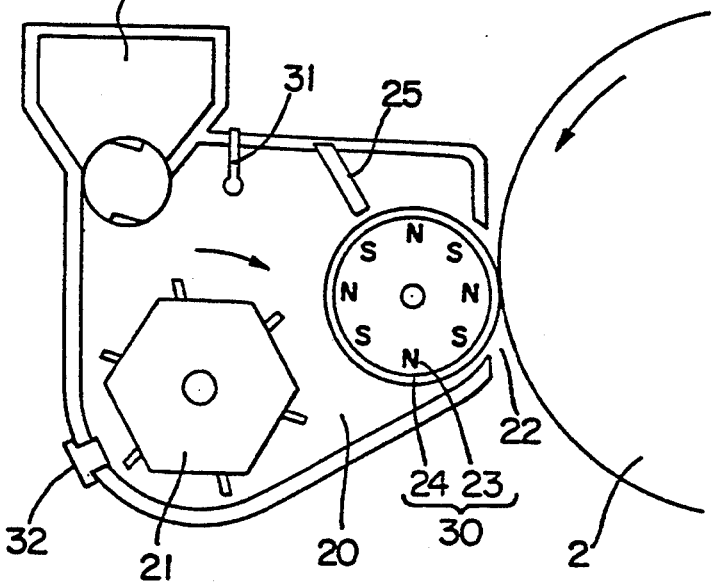
FIG. 2 is a section view showing the construction of the developing device of the aforesaid electrophotographic copying machine.

The previously mentioned developing device 4 has a container portion 20 that accommodates a two-component developing material comprising a magnetic toner and a carrier, as shown in FIG. 2. The aforesaid container portion 20 is provided with an opening 22 that confronts the photosensitive drum 2. The developing roller 30 is disposed in the aforesaid opening 22, said developing roller 30 comprising a magnetic roller 23 and a developing sleeve 24 which covers the magnetic roller 23. The aforesaid magnetic roller 23 is constructed so as to rotate in the clockwise direction during the developing process, such that by means of the aforesaid rotation the magnetic toner particles are caused to adhere to the surface of the carrier particles due to triboelectric charging between the carrier and the toner which produces the charge necessary for developing and the toner is thereby transported in the clockwise direction in conjunction with the clockwise rotation of the magnetic roller 23. Thus, the magnetic toner is caused to adhere to the electrostatic latent image formed on the surface of the photosensitive drum 2, so as to develop said latent image as a toner image. A toner blade 25 is also provided on the interior wall of the previously mentioned container portion 20 to regulate the developing material brush height so as to maintain a uniform level. At the back side of the toner blade 25 (hereinafter the "back side" refers to the side opposite that of the photosensitive drum 2) is provided a humidity sensor 31 for detecting the humidity within the container portion 20. Additionally, at the back side of the developing roller 30 is provided a bucket roller 21 for mixing the toner accommodated in the container portion 20. An ATDC sensor 32 is provided behind the aforesaid bucket roller 21 to detect the toner-to-carrier ratio (T/C ratio). A toner tank 14 is also provided at the top of the container portion 20 to supply toner to the container portion 20 in accordance with the controls of the present invention.

Figure 3:
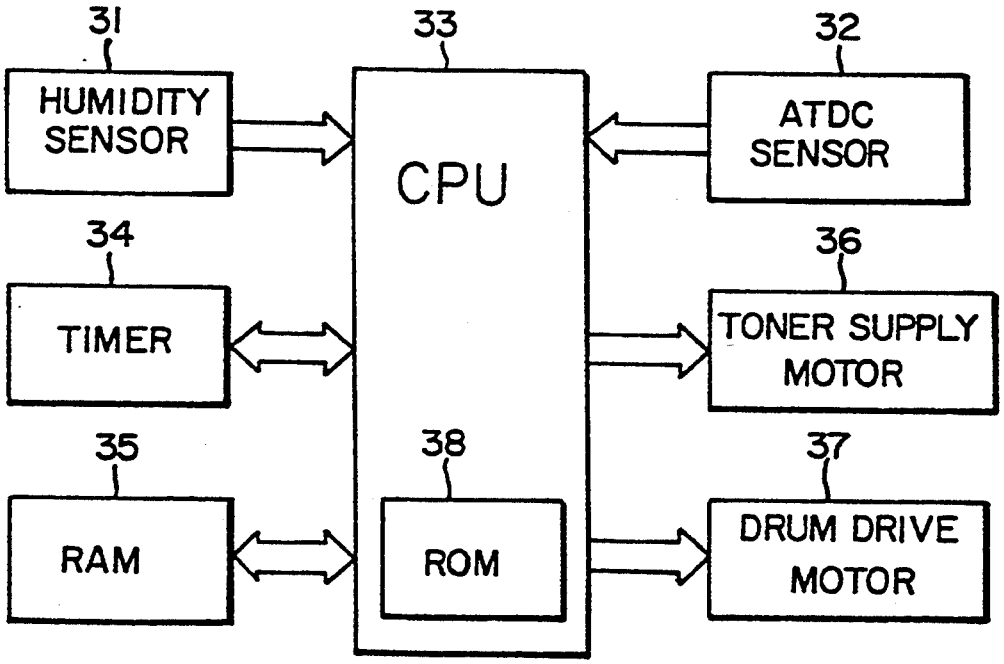
FIG. 3 is a plan view of the control circuit of the aforesaid electrophotographic copying machine.

The previously mentioned humidity sensor 31 and the ATDC sensor 32 are connected to the central processing unit (CPU) 33, as shown in FIG. 3. A nonvolatile random access memory (RAM) 35 is connected to the CPU 33 and stores "n" batch data for the humidity sensor 31 and the timer 34 that regulates the output timing for said humidity sensor 31. Also connected to the CPU 33 is a toner supply motor 36 for supplying toner from the previously described toner tank 14 to the container portion 20, and a drum drive motor 37 that actuates the photosensitive drum 2.

The CPU 33 calculates the mean value $\Sigma H_n/n$ for past humidity based on the past humidity data stored in the previously mentioned RAM 35. The relationship between the aforesaid mean value $\Sigma H_n/n$ and the current humidity $H_0$ is discriminated as the state indicated by line segment A (described by Equation 1 below), line segment B (described by Equation 2 below), or line segment C (described by Equation 3 below), as shown in FIG. 4, the X value (ATDC sensor 32 output value) is corrected, and a decision is made to actuate either the toner supply motor 36 or the drum drive motor 37, or start the copy operation in the current state.

Figure 4:
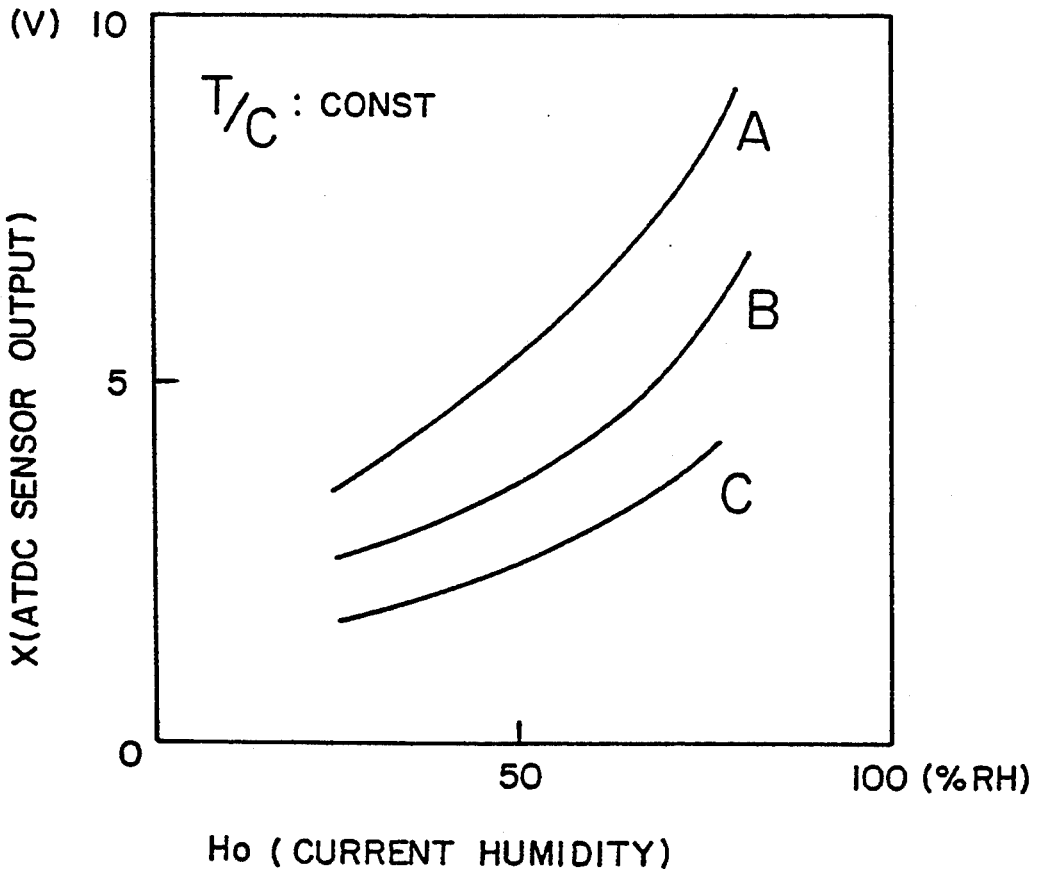
FIG. 4 is a graph showing the relationship between the current humidity ($H_0$) and the ATDC sensor output values (x) for various states of humidity.

In FIG. 4, the line segment A expresses the relationship between the values $H_0$ and X immediately after the main switch is switched to the ON state in the morning, i.e., when the humidity is low; the line segment B expresses the relationship between the values $H_0$ and X when a suitable time period has elapsed after the main switch is switched to the ON state, i.e., when the humidity is constant; and the line segment C expresses the relationship between the values $H_0$ and X when the humidity is high, such as after a sudden rainfall or the like.

$$\Sigma H_n/n > H_0 \quad (1)$$

$$\Sigma H_n/n \approx H_0 \quad (2)$$

$$\Sigma H_n/n < H_0 \quad (3)$$

A more thorough description of the value correction method follows hereinafter. The internal read only memory (ROM) 38 of the CPU 33 contains tables of the current humidities and the corrected ATDC sensor outputs corresponding to each of the aforesaid curves in FIG. 4, with respect to each detected ATDC sensor output (toner density) For example, when the ideal toner density is 7% with a range of variation of ±2%, the aforesaid table in ROM 38 stores data A-5, A-6, A-7, A-8 and A-9 (the numerals 5 through 9 express the detected toner density) relative to line segment A in FIG. 4 and, similarly, the data B-5, B-6, B-7, B-8 and B-8, and C-5, C-6, C-7, C-8 and C-9 correspond to the line segments B and C, respectively.

When the CPU 33 recognizes the detected ATDC sensor output (toner density), the current humidity and the mean value for past humidity, and the CPU 33 determines which table group to use, i.e., the table A group, table B group or the table C group, based on the relationships expressed by the aforesaid equations 1, 2 and 3. Then, a single table is selected from among the appropriate table group in correspondence with the detected ATDC sensor output. Subsequently, the corrected ATDC sensor output is selected from the table by means of the current humidity. Therefore, a corrected ATDC sensor output can be obtained by considering the current humidity and the recorded past humidity, and the image density can be controlled based upon said corrected value.

Figure 5:
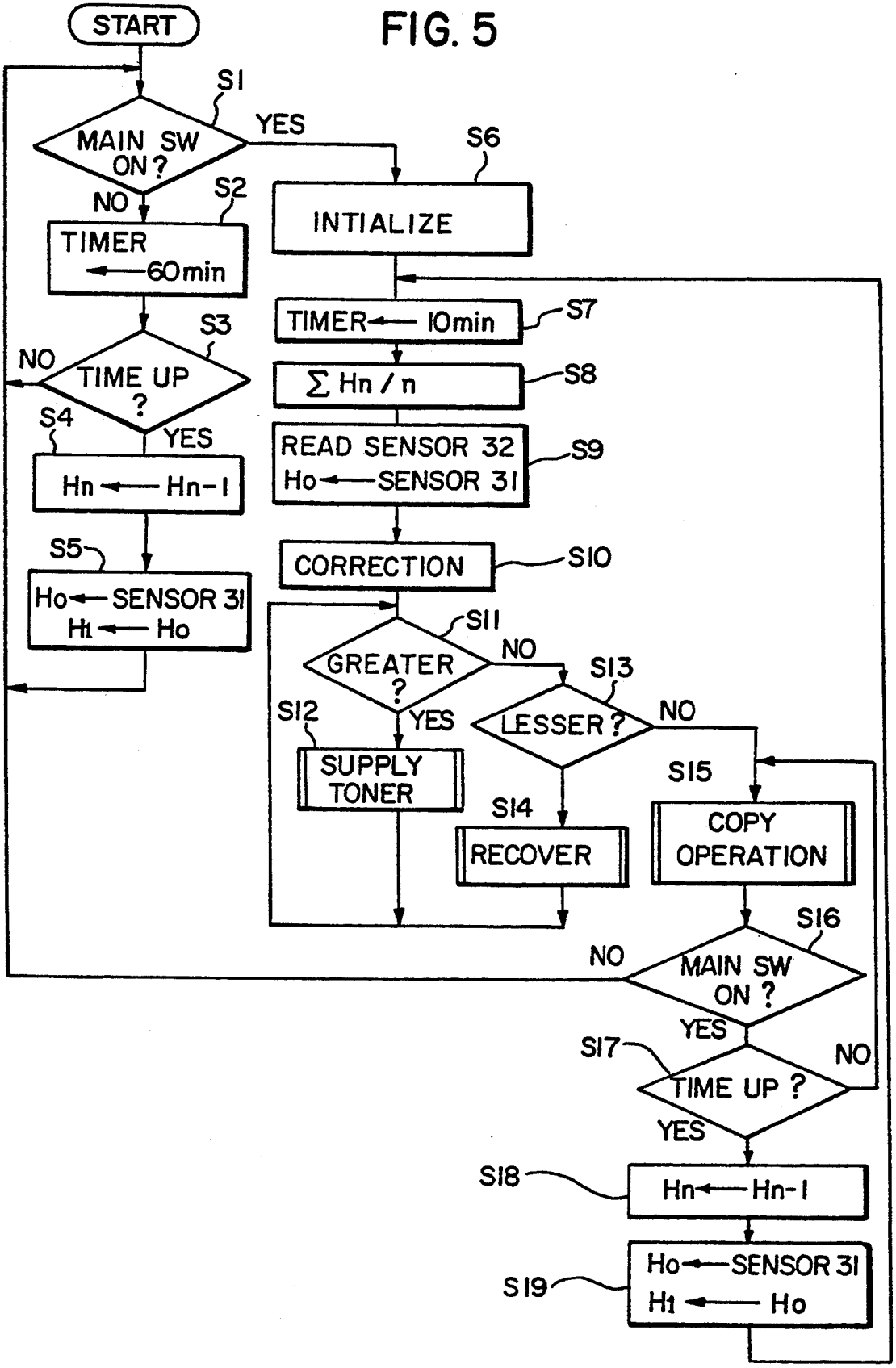
FIG. 5 is a flow chart showing the control sequence of the present embodiment of the invention.

FIG. 5 is a flow chart showing the operation of the copying machine executed by the previously described CPU 33.

First, a check is made to determine whether or not the main switch is ON in step S1. If the main switch is in the OFF state, the routine continues to step S2 where the timer is set at 60 minutes, and in step S3 the timer is monitored to detect the passage of each 60 minute period. The oldest data $H_n$ is discarded upon the completion of each 60 minute period detected by the aforesaid monitoring, and the storage position of the remaining data is shifted in the register (for example, the data stored in the $H_{n-1}$ position is shifted to the $H_n$ position) in step S4. Then, in step S5, the humidity sensor output value $H_0$ is designated $H_1$ and stored in the RAM 35.

On the other hand, when the check made in step S1 determines that the main switch is in the ON state, each part of the copying machine is initialized in step S6. Then, the timer is set at 10 minutes in step S7, and the mean value $\Sigma H_n/n$ is calculated for the humidity sensor data for the passage of n cycles (step S8). When the aforesaid operation is completed, the output form the ATDC sensor 32 is read, and the output value of the humidity sensor 31 is set at $H_0$ (the current humidity) in step S9. Subsequently, in step S10, the tables stored in ROM 38 are referenced, and the output value of the ATDC sensor 32 is corrected in accordance with the values $\Sigma H_n/n$ and $H_0$.

When the previously described Equation 2 is applicable (when the environment is stable), the relationship between X (ATDC sensor 32 output voltage) and $H_0$ (humidity during copy operation) is expressed by the line segment B, and the ATDC sensor 32 output value is therefore corrected so as to conform to the humidity $H_0$ during the copy operation.

When the aforesaid Equation 1 is applicable, on the other hand, the relationship between X and $H_0$ is expressed by the line segment A. Since the line segment A is shifted higher than the line segment B, the toner will be oversupplied if the output value of the ATDC sensor 32 that has been previously corrected to conform to the humidity $H_0$ during the copy operation is not once again corrected with the past humidity data. Accordingly, the ATDC sensor 32 output value is corrected relative to the variation of the mean value $\Sigma H_n/n$ of the humidity data over the previous n cycles.

Further, when the aforesaid Equation 3 is applicable, the relationship between X and $H_0$ is expressed by the line segment C. Since the line segment C is shifted lower than the line segment B, the toner will be undersupplied if the output value of the ATDC sensor 32 is not corrected. Accordingly, the ATDC sensor 32 output value is corrected relative to the variation of the mean value $EH_n/n$ of the humidity data over the previous n cycles.

Thus, when the ATDC sensor 32 output is corrected, a check is made to determine whether or not the corrected value is greater than a specified reference value (steps S11, S13), and toner replenishment is executed when said corrected value is greater than the specified reference value (step S12).More specifically, the toner supply motor 36 is actuated, and toner is supplied from the toner tank into the toner container portion 20.

On the other hand, when the ATDC sensor 32 output value is less than the specified reference value, the toner is recovered (step S14). More specifically, the photosensitive drum 2 is charged and the drum drive motor 37 is actuated to achieve idle rotation of the photosensitive drum 2, and the toner adhering to the surface of the photosensitive drum 2 is removed by the previously mentioned cleaning blade 7*a* so as to recover said toner.

When the corrected value is suitable so as to be neither too large or too small, the toner density is deemed ideal, and the copy enabled state is entered. Thereafter, the copy operation starts when the copy switch is switched ON (step S15). The aforesaid copy enabled state continues for a 10 minute period, and the toner is replenished in accordance with the number of copy sheets so as to maintain the ATDC sensor 32 output at a constant level. On the other hand, if the check made in step S17 discloses the completion of the timer, the oldest data $H_n$ among the past humidity data is discarded, the storage position in the register of the remaining data is shifted (step S18), and the humidity sensor 31 output value $H_0$ is stored in RAM 35 at the empty address for $H_1$ (step S19). Then, a check is made to determine whether or not the main switch is in the ON state (step S16). If the main switch is in the OFF state, the routine returns to step S2 and the timer is set at 60 minutes.

In the previously described embodiment the humidity data is updated every hour when the main switch is in the OFF state, and updated every 10 minutes when the main switch is in the ON state, so as to execute the mixing operation during the copy process and facilitate response to the environment. However, the set time periods are not limited to those given in the preceding examples.

Although simple mean values were used as the values expressing the state of variation in past humidity in the aforesaid embodiment, it should be noted that the variation values are not limited to expression as simple mean values, and that data may be adjusted such that the current data are weighted, such as described in Equations 4 and 5. The print quality can be greatly improved when the aforesaid type of weighted data are used.

$$\sum_{i=1}^{n}\left(\frac{Hi}{i}\right) \qquad \text{Equation 4}$$

$$\sum_{i=1}^{n}[(n-1)\cdot Hi] \qquad \text{Equation 5}$$

When the maximum and minimum values for past humidity are previously stored in memory, these values may be used in conjunction with the current prevailing humidity to determine the correction value.

Although in the present embodiment control of the quantity of toner supplied to the photosensitive drum 2 is accomplished by increasing and decreasing the toner supplied to the developing device 4, it should be noted that control is not limited to the previously described method and also may be accomplished by modifying the bias voltage applied to the photosensitive drum 2.

According to the preceding description of the present invention, the state of variation of the past humidity is compared with the current prevailing humidity to control the quantity of toner supplied to the image-bearing member, such that uniform image quality can be maintained even when images are formed under conditions of sudden humidity changes. Accordingly, the performance of the image forming apparatus can be rapidly and effectively improved.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

an image forming means for forming images by use of an electrophotographic process, said image forming means including a developing means for developing electrostatic latent images on a photosensitive medium by a developer which comprises toner and carrier;

toner density detecting means for detecting toner density of the developer;

humidity detecting means, provided near the developing means, for detecting humidity adjacent the developing means;

means for storing a past record of humidity detected within a set predetermined time period;

means for storing a series of values of toner density relative to humidity, each series of values being representative of a different toner density value for the same humidity; and means for controlling the image forming means in correlation with detected toner density and the stored past record of humidity so as to maintain image density stability, including selecting one of the series of values to correct the toner density.

2. An image forming apparatus as claimed in claim 1, wherein the image forming apparatus further includes a toner supply means for supplying toner into the developing means, and the control means controls the toner supply means so as to supply toner in the developing means when the detected toner density is lower than predetermined standard density.

3. An image forming apparatus as claimed in claim 2, wherein detected toner density is corrected in accordance with past record of humidity before being compared with the stored predetermined standard density.

4. An image forming apparatus as claimed in claim 2, wherein when the detected toner density is higher than the predetermined standard density control means controls the image forming means so as to recover toner density by a process in which the photosensitive medium is uniformly charged and developed and thereafter is cleaned by a cleaner which removes toner on the photosensitive medium.

5. An image forming apparatus as claimed in claim 4, wherein the detected toner density is corrected in accordance with past record of humidity before being compared with the predetermined standard density.

6. An image forming apparatus as claimed in claim 1, wherein said past record of humidity has a plurality of humidity data detected by the humidity detecting means every time a predetermined time is passed.

7. An image forming apparatus as claimed in claim 6, wherein a predetermined time period which is set when a power off state of the apparatus occurs is longer than a time period that is set in a power on state of the apparatus.

8. An image forming apparatus as claimed in claim 6, wherein said plurality of humidity data is calculated into a means value.

9. An image forming apparatus comprising:

an image forming means for forming toner images on a photosensitive medium, said image forming means including a developing means for developing electrostatic latent images on the photosensitive medium by a developer which comprises toner and carrier, including a housing for storing the developer;

toner density detecting means for detecting toner density of the developer;

humidity detecting means, provided within the developer housing for detecting humidity adjacent the developing means;

means for storing a series of values of toner density relative to humidity, each series of values being representative of a different toner density value for the same humidity;

means for storing a past record of humidity detected within a set predetermined time period; and means for controlling the image forming means by referring to the detected toner density, the stored past record of humidity, and a currently detected humidity so as to maintain image density stability, including selecting one of the series of values to correct the toner density.

10. An image forming apparatus as claimed in claim 9, wherein the image forming apparatus further includes a toner supply means for supplying toner into the developing means, and the control means controls the toner supply means so as to supply toner in the developing means when the toner density is lower than a predetermined standard density.

11. An image forming apparatus as claimed in claim 10, wherein the detected toner density is corrected in accordance with the past record of humidity and a currently detected humidity before being compared with the predetermined standard density.

12. An image forming apparatus as claimed in claim 10, wherein when a detected toner density is higher than the predetermined standard density, the control means controls the image forming means so as to recover toner density up to the predetermined standard density by a process in which the photosensitive medium is uniformly charged and developed and thereafter is cleaned by a cleaner which removes toner on the photosensitive medium.

13. An image forming apparatus as claimed in claim 12, wherein detected toner density is corrected in accordance with a past record of humidity and a currently detected humidity before being compared with the predetermined standard density.

14. An image forming apparatus as claimed in claim 9, wherein said past record of humidity has a plurality of humidity data detected by humidity detecting means every time a predetermined time period is passed.

15. An image forming apparatus as claimed in claim 14, wherein said predetermined time period set for a power off state of the apparatus is longer than that set for a power on state of the apparatus.

16. An image forming apparatus as claimed in claim 14, wherein said plurality of humidity data is calculated into a means value.

17. An image forming apparatus comprising:

an image forming means for forming images by use of an electrophotographic process, said image forming means including a developing means for developing electrostatic latent images on a photosensitive medium by a developer which comprises toner and carrier;

toner density detecting means for detecting toner density of the developer;

humidity detecting means for detecting humidity adjacent the developing means;

means for periodically storing a detected humidity and maintaining it for a predetermined time period regardless of any operation of the image forming means;

means for periodically discarding a stored detected humidity regardless of any operation of the image forming means, and means for controlling the image forming means in correlation with detected toner density, a presently-stored detected humidity, a detected current humidity, and a stored table of correction values corresponding to a toner density value relative to humidity for various humidity states.

18. An image forming apparatus as claimed in claim 17, further including a timer means for setting the periodic storage cycle, including a first reference timer period for a power-on state and a second, different reference time period for a power-off state.

19. An electrophotographic image forming apparatus comprising:

an image forming means for forming images by use of an electrophotographic process, said image forming means including a developing means for developing electrostatic latent images on a photosensitive medium by a developer which comprises toner and carrier;

toner density detecting means for detecting a toner density of the developer;

humidity detecting means, provided near the developing means, for detecting humidity adjacent the developing means;

means for storing a plurality of previously-detected humidity values detected within a set predetermined time period; and means for controlling the image forming means in correlation with detected toner density and the plurality of previously-detected humidity values so as to maintain the image density stable.

20. An electrophotographic image forming apparatus comprising:

an image forming means for forming toner images on a photosensitive medium, said image forming means including a developing means for developing electrostatic latent images on the photosensitive medium by a developer which comprises toner and carrier;

toner density detecting means for detecting toner density of the developer;

humidity detecting means, provided near the developing means, for detecting humidity adjacent the developing means;

means for storing a past record of humidity detected within a set predetermined time period; and means for controlling the image forming means by referring to the detected toner density, the stored past record of humidity, and a currently detected humidity so as to maintain image density stability.

21. An electrophotographic image forming apparatus comprising:

an image forming means for forming images by use of an electrophotographic process, said image forming means including a developing means for developing electrostatic latent images on a photosensitive medium by a developer which comprises toner and carrier;

toner density detecting means for detecting toner density of the developer;

humidity detecting means for detecting humidity adjacent the developing means;

means for periodically storing a detected humidity and maintaining it for a predetermined time period regardless of any operation of the image forming means;

means for periodically discarding a stored detected humidity regardless of any operation of the image forming means; and means for controlling the image forming means in correlation with detected toner density, a presently-stored detected humidity, and a detected current humidity.

22. An electrophotographic image forming apparatus as claimed in claim 21, further including a timer means for setting the periodic storage cycle, including a first reference timer period for a power-on state and a second, different reference time period for a power-off state.

23. An electrophotographic image forming apparatus as claimed in claim 22, further including a stored table of correction values corresponding to a toner density value relative to humidity for various humidity states and means for modifying the means for controlling the image forming means in accordance with a correction value.

* * * * *